US006116591A

United States Patent [19]

Kim

[11] Patent Number: 6,116,591

[45] Date of Patent: Sep. 12, 2000

[54] PAPER SUPPLY TRAY OF PRINTER

[75] Inventor: Jeong-hoon Kim, Suwon, Rep. of Korea

[73] Assignee: Samsung Electronics Co., Ltd., Kyungki-Do, Rep. of Korea

[21] Appl. No.: 09/283,977

[22] Filed: Apr. 1, 1999

[30] Foreign Application Priority Data

Apr. 1, 1998 [KR] Rep. of Korea ..... 98-11528

[51] Int. Cl.[7] ..... B65H 1/08; B65H 5/26

[52] U.S. Cl. ..... 271/171; 271/222; 271/126; 271/127

[58] Field of Search ..... 271/171, 222, 271/126, 127

[56] References Cited

U.S. PATENT DOCUMENTS

| | | | |
|---|---|---|---|
| 4,343,461 | 8/1982 | Tomimori et al. | 271/22 |
| 4,422,631 | 12/1983 | Sugizaki | 271/9 |
| 4,780,740 | 10/1988 | Fukae | 355/3 |
| 4,786,042 | 11/1988 | Stemmle | 271/9 |
| 5,071,111 | 12/1991 | Iwamoto et al. | 271/145 |
| 5,292,117 | 3/1994 | Takagi et al. | 271/234 |
| 5,437,444 | 8/1995 | Kawakami et al. | 271/22 |
| 5,573,235 | 11/1996 | Asai | 271/121 |
| 5,848,787 | 12/1998 | Miki | 271/171 |
| 5,938,190 | 8/1999 | Campbell et al. | 271/171 |
| 5,951,002 | 9/1999 | Yokota | 271/117 |
| 5,988,621 | 11/1999 | Kondo et al. | 271/3.02 |
| 6,053,491 | 4/2000 | Cheong | 271/9.09 |

FOREIGN PATENT DOCUMENTS

| | | | |
|---|---|---|---|
| 57-4835A | 1/1982 | Japan | 271/171 |
| 60-242140 | 12/1985 | Japan | B65H 1/26 |
| 8-40572 | 2/1996 | Japan | B65H 1/04 |
| 8-239128 | 9/1996 | Japan | B65H 1/04 |
| 1419508 | 12/1972 | United Kingdom | 271/171 |

*Primary Examiner*—Christopher Ellis
*Assistant Examiner*—Michael E. Butler
*Attorney, Agent, or Firm*—Sughrue, Mion, Zinn, Macpeak & Seas, PLLC

[57] ABSTRACT

A paper supply tray of a printer, including: a main body, for receiving sheets of paper or other printable material, insertable into and detachable from the printer; a guide, for supporting an edge of the received sheet, capable of sliding in the main body; a locking mechanism for immovably locking the guide; and a plurality of position determining holes formed in the main body along a path where the guide is slidable. The locking mechanism has: an actuator; a pivot lever installed in the guide and having a hinge portion which is bent and contacts the inner wall of the guide, the pivot lever also having an upper end interlocked with the actuator; a stopper installed in the guide to move up and down, and to selectively interlock with the lower end of the pivot lever to fall down when the pivot lever is rotated to, thereby, be partially inserted into one of the position determining holes; a first elastic member supplying elasticity to get the stopper out of the position determining hole; and a second elastic member supplying elasticity to the pivot lever to contact the hinge of the pivot lever with the inner wall of the guide.

3 Claims, 7 Drawing Sheets

PAPER SUPPLY TRAY OF PRINTER

BACKGROUND OF THE INVENTION

1. Field of the Invention

The present invention relates to a paper supply tray used for a printer such as a laser printer or a photocopier.

2. Description of the Related Art

As shown in FIG. 1, a typical printer includes a paper supply tray for receiving sheets of paper or other printable material and conveying the received sheets to a printer body 10. The paper supply tray includes a main body 20 in which sheets are received, a pair of side guides 21 and 22 supporting the side edges of the received sheet, slidably installed in the main body 20, and a top guide 23 supporting top edges of sheets. Reference numeral 24 indicates a finger member compressing and supporting a corner portion of bottom edges of the received sheets, and reference numeral 25 indicates a settling plate elastically-biasing the received sheets towards the finger member 24.

Here, as shown in FIG. 2, the side guides 21 and 22 interlock with a pinion 27 rotatably installed at the bottom of the main body 20. Also, a locking protrusion 22*a*' formed at an elastic piece 22*a* of each of the side guides 21 and 22 is elastically engaged with a locking groove 28*a* formed in a guide rail 28, to thereby adjust the position thereof in accordance with the size of the sheet.

Also, as shown in FIG. 3, the position of the top guide 23 is predetermined by connecting a teethed portion 29 of the main body 20 to a connection piece 23*a*. Thus, sheets are received in the main body 20, and then the side guides 21 and 22 and the top guide 23 are adjusted in accordance with the paper size, such that the locking protrusion 22*a*' and the locking groove 28*a*, and the teethed portion 29 and the connection piece 23*a* are locked, respectively.

However, when sheets are received in the main body 20, and then the paper supply tray is inserted into the printer body 10 (FIG. 1), the locking of the locking protrusion 22*a*' and the locking groove 28*a*, and the teethed portion 29 and the connection piece 23*a* may become disengaged due to connection shock or the inertial force of the sheet. With a larger number of received sheets, the locking may more easily become disengaged. When the locking of the guides 21, 22 and 23 are disengaged, the sheets may become jammed in the printer, so that the supply of a sheet or printing cannot be operated normally.

SUMMARY OF THE INVENTION

To solve the above problem, it is an objective of the present invention to provide a paper supply tray of a printer capable of stably maintaining the locking of guides even in the case of many received sheets.

To achieve the above objective, there is provided a paper supply tray of a printer including a main body for receiving sheets of paper or other printable material, insertable into and detachable from the printer, a guide for supporting an edge of the received sheet, capable of sliding in the main body, and a locking mechanism for immovably locking the guide, wherein a plurality of position determining holes are formed in the main body along a path where the guide is slidable, and the locking mechanism comprises:

an actuator;

a pivot lever installed in the guide and having a hinge portion which is bent and contacts the inner wall of the guide, the pivot lever also having an upper end interlocked with the actuator;

a stopper installed in the guide to move up and down, and to selectively interlock with the lower end of the pivot lever to fall down when the pivot lever is rotated, to thereby be partially inserted into one of the position determining holes;

a first elastic member supplying elasticity to get the stopper out of the position determining hole; and a second elastic member supplying elasticity to the pivot lever to contact the hinge of the pivot lever with the side walls of the guide.

In a preferred embodiment, protrusions are protruded from the pivot lever, support rails supporting the protrusion are formed in the guide, and the protrusions are slidable along the support rails when the pivot lever is rotated.

BRIEF DESCRIPTION OF THE DRAWINGS

The above objectives and advantages of the present invention will become more apparent by describing in detail a preferred embodiment thereof with reference to the attached drawings in which.

DESCRIPTION OF THE PREFERRED EMBODIMENTS

Figure 1:
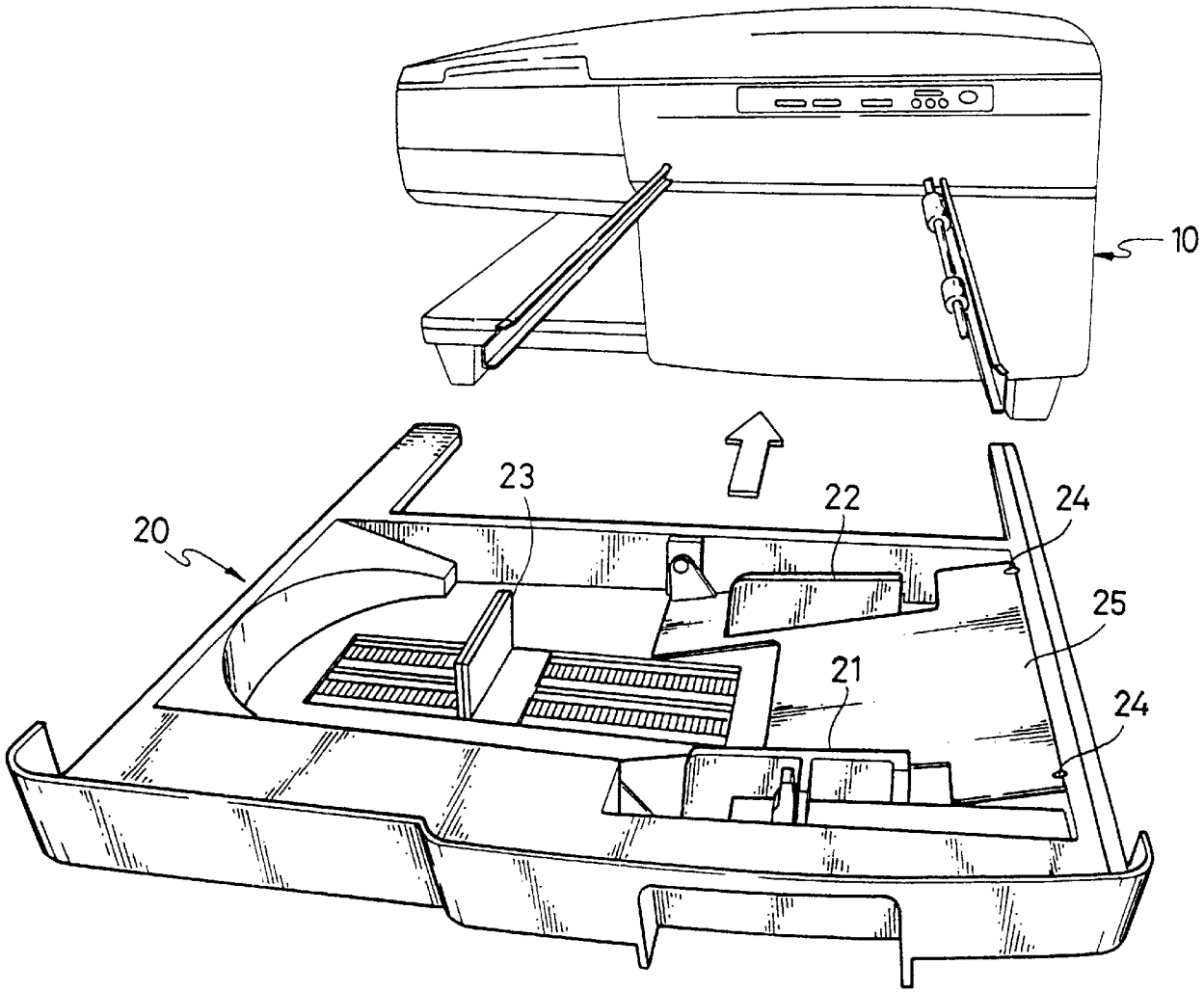
FIG. 1 (PRIOR ART)
FIG. 1 is a perspective view of a conventional paper supply tray of a printer.
Figures 2A, 2B:
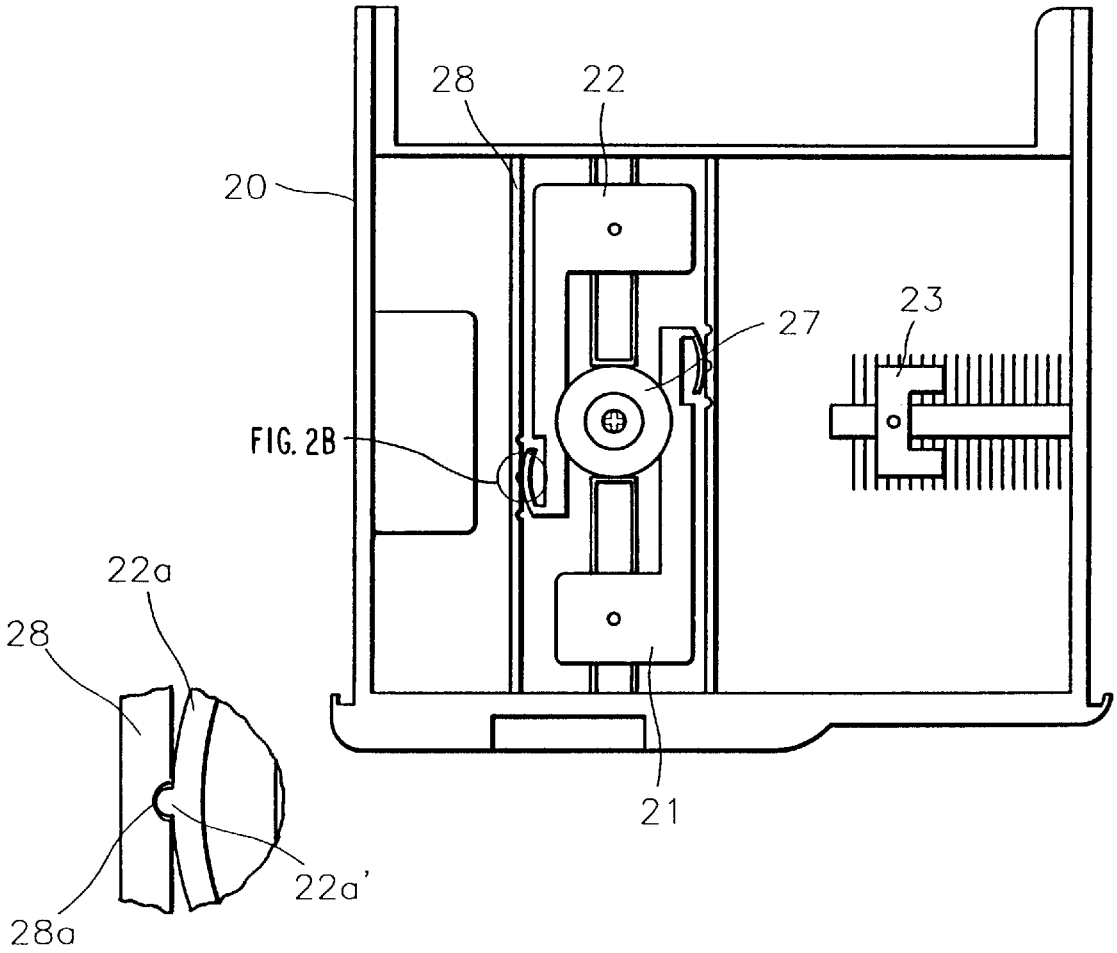
FIG. 2A (PRIOR ART)
FIG. 2B (PRIOR ART)
FIG. 2 is a bottom view of the paper supply tray of FIG. 1.
Figure 3:
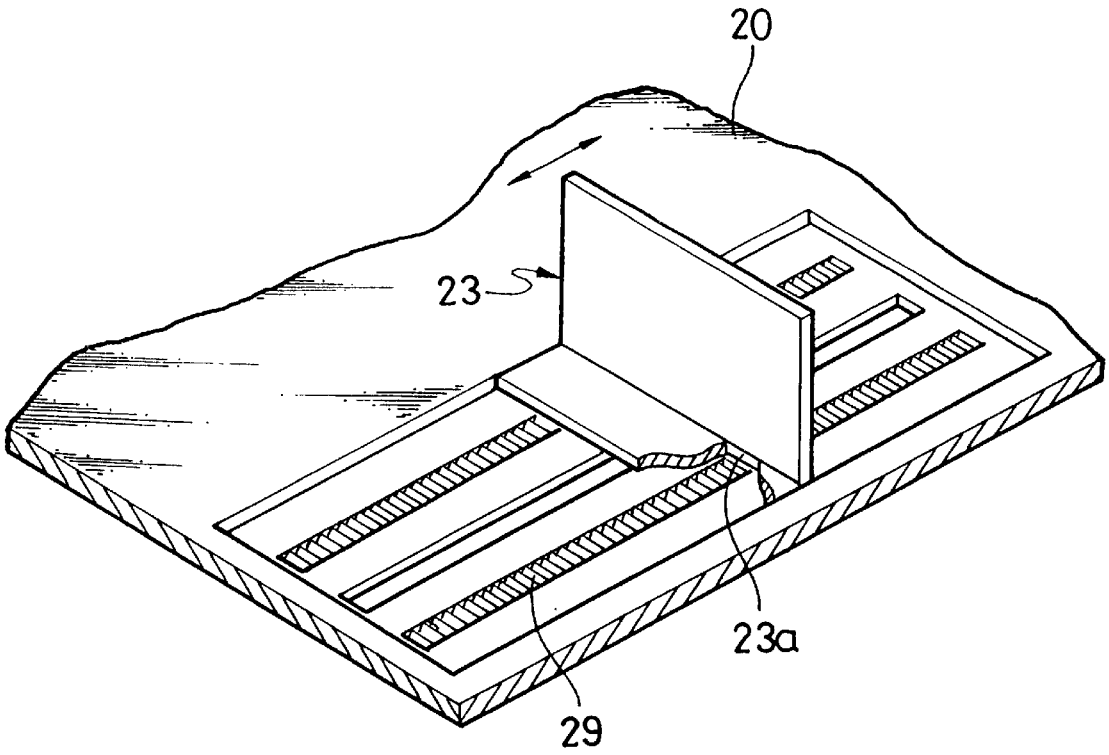
FIG. 3 (PRIOR ART)
FIG. 3 is a view partially showing a portion in which a guide of the paper supply tray of FIG. 1 is installed.
Figure 4:
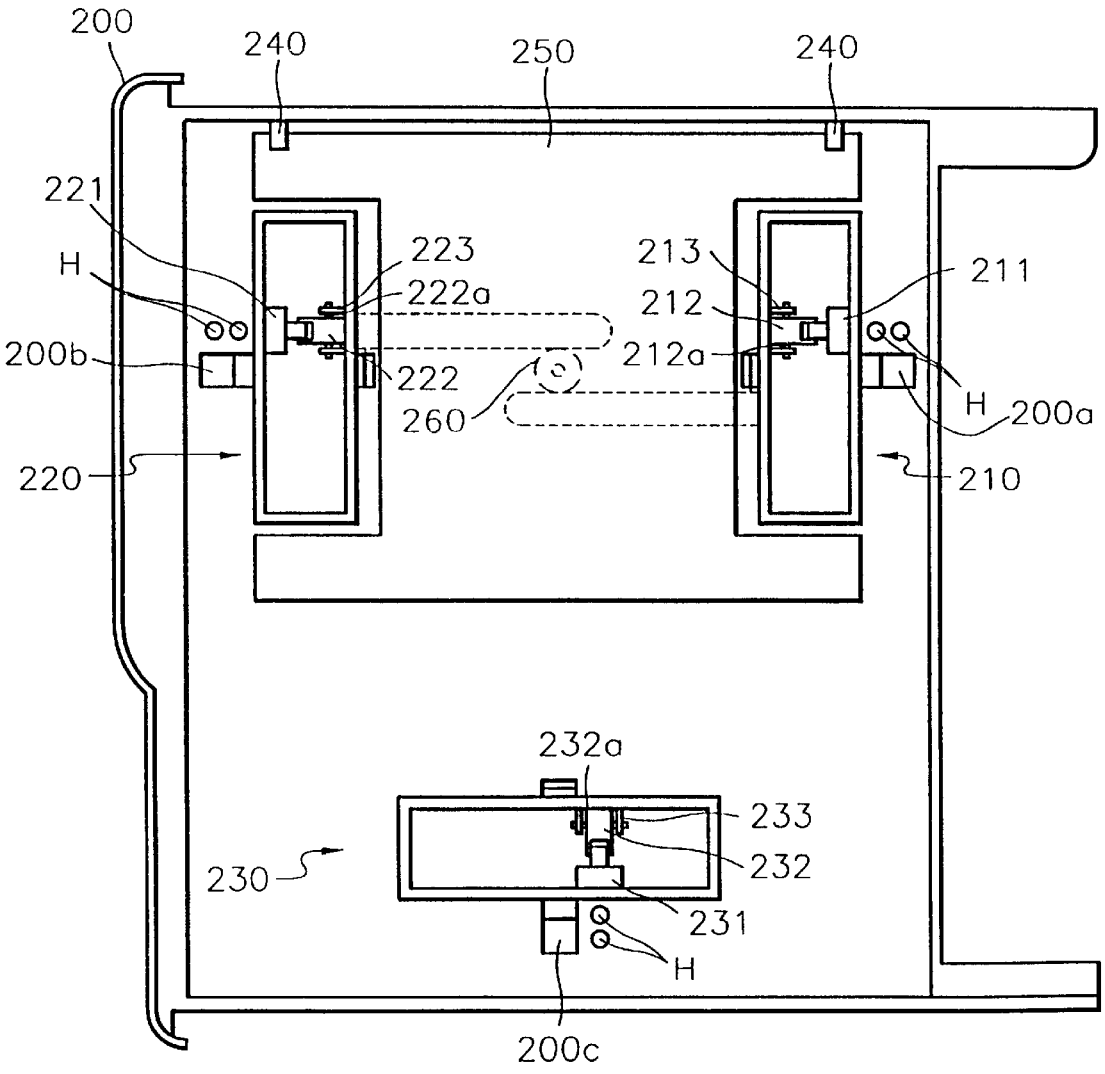
FIG. 4 is a plan view of a paper supply tray of a printer according to the present invention.

As shown in FIG. 4, a paper supply tray according to a preferred embodiment of the present invention includes a main body 200 in which sheets of paper or other printable material are received, side guides 210 and 220 and a top guide 230 slidably installed in the main body 200, contacting the side edges and the top edges of sheets respectively, a finger member 240 compressing and supporting a corner portion of a rear edge of the received sheet, and a settling plate 250 elastically biasing the received sheets towards the finger member 240.

Here, the guides 210, 220 and 230 are connected to slots 200*a*, 200*b* and 200*c* formed in the main body 200, respectively, and move along the slots 200*a*, 200*b* and 200*c*. A plurality of position determining holes H are formed in one side of each of the slots 200*a*, 200*b* and 200*c*.

Figure 5:
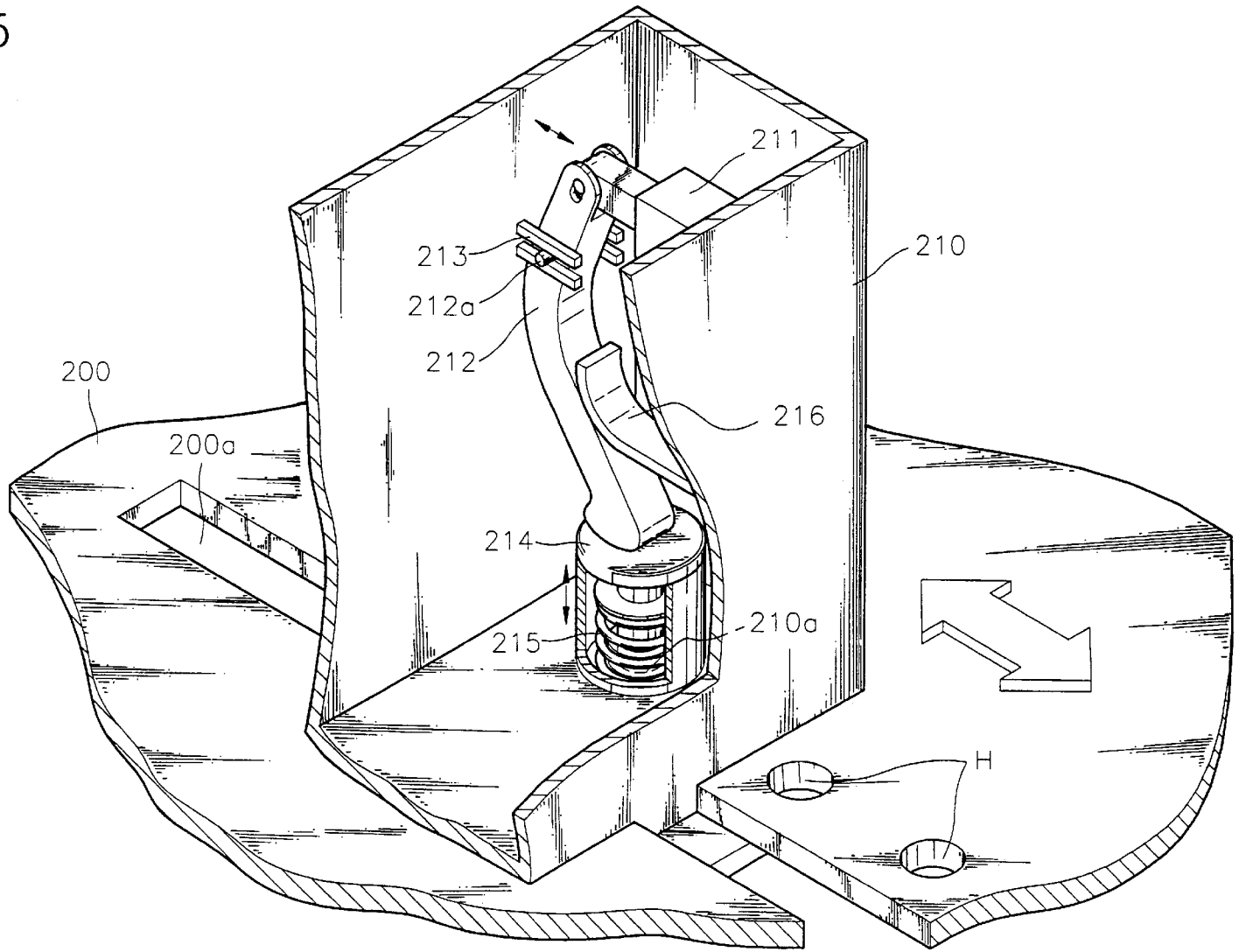
FIG. 5 is a perspective view partially cutting a portion in which a guide of the paper supply tray of FIG. 4 is installed.

Each of the guides 210, 220 and 230 include a locking mechanism, which includes pivot levers 212, 222 and 232, and solenoids 211, 221 and 231 driving pivot levers 212, 222 and 232. Referring to FIG. 5, a stopper 214 for locking the guide 210 by being selectively inserted into the position determining hole H is installed in the guide 210. The stopper 214 protrudes downward through the locking hole 210*a* formed at the bottom of the guide 210, and has upward elasticity to disengage the locking of the spring 215.

The pivot levers 212, 222 and 232 have a curved shape similar to a boomerang, and each has protrusions 212*a*, 222*a* and 232*a* formed at the respective sides thereof. Referring to FIG. 5, the protrusion 212*a* is supported by a support rail

213 formed on the inner wall of the guide 210, and thus a hinge portion 212*b* (FIG. 6), which is obtained by bending the pivot lever 212, contacts the inner wall of the guide 210. The pivot lever 212 has an upper end interlocking the solenoid 211, and a lower end selectively contacting the upper surface of the stopper 214. Reference numeral 216 indicates a leaf spring elastically biasing the pivot lever 212 such that the hinge portion 212*b* contacts the inner wall of the guide 210.

Figure 6:
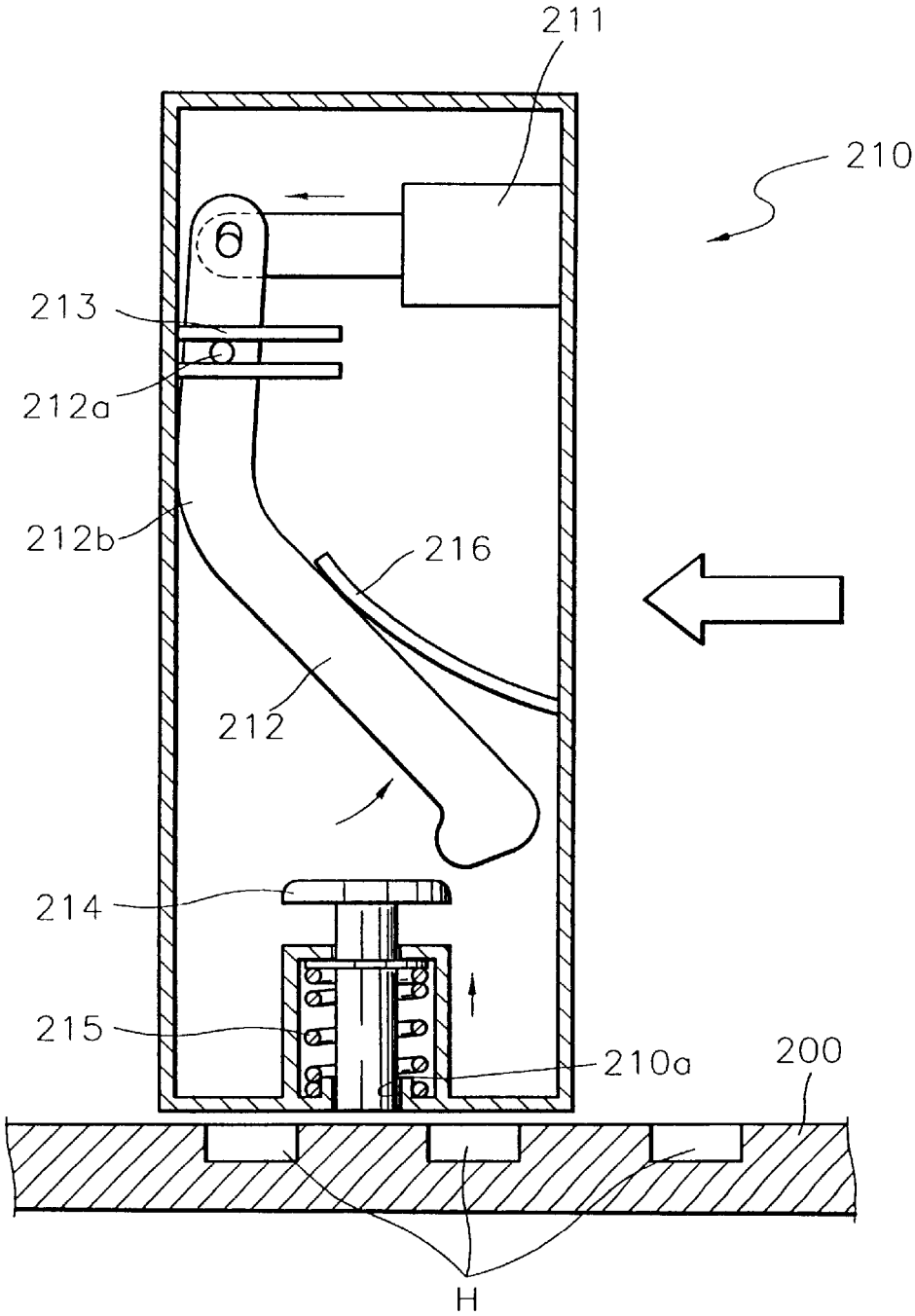
FIGS. 6 and 7 are sectional views of the unlocking state and the locking state of a guide in the paper supply tray of FIG. 4.

To adjust the position of the above-described guide 210, the solenoid 211 moves forward and thus the pivot lever 212 pivots counterclockwise around the hinge portion 212*b*, as shown in FIG. 6. Thus, the lower end of the pivot lever 212 is separated from the upper surface of the stopper 214, so that the stopper 214 rises due to the elasticity of a compression spring 215 to go out of the position determining hole H. At this time, the guide 210 is slid along the slot 200*a* (FIG. 5) in accordance with the size of the received sheet to be positioned at an appropriate place. Here, an end of the stopper 214 is positioned at an upper portion of one of the position determining holes H formed in the main body 200. The number of the position determining holes H and an interval thereof are predetermined in accordance with the size of the sheets received in the paper supply tray.

Figure 7:
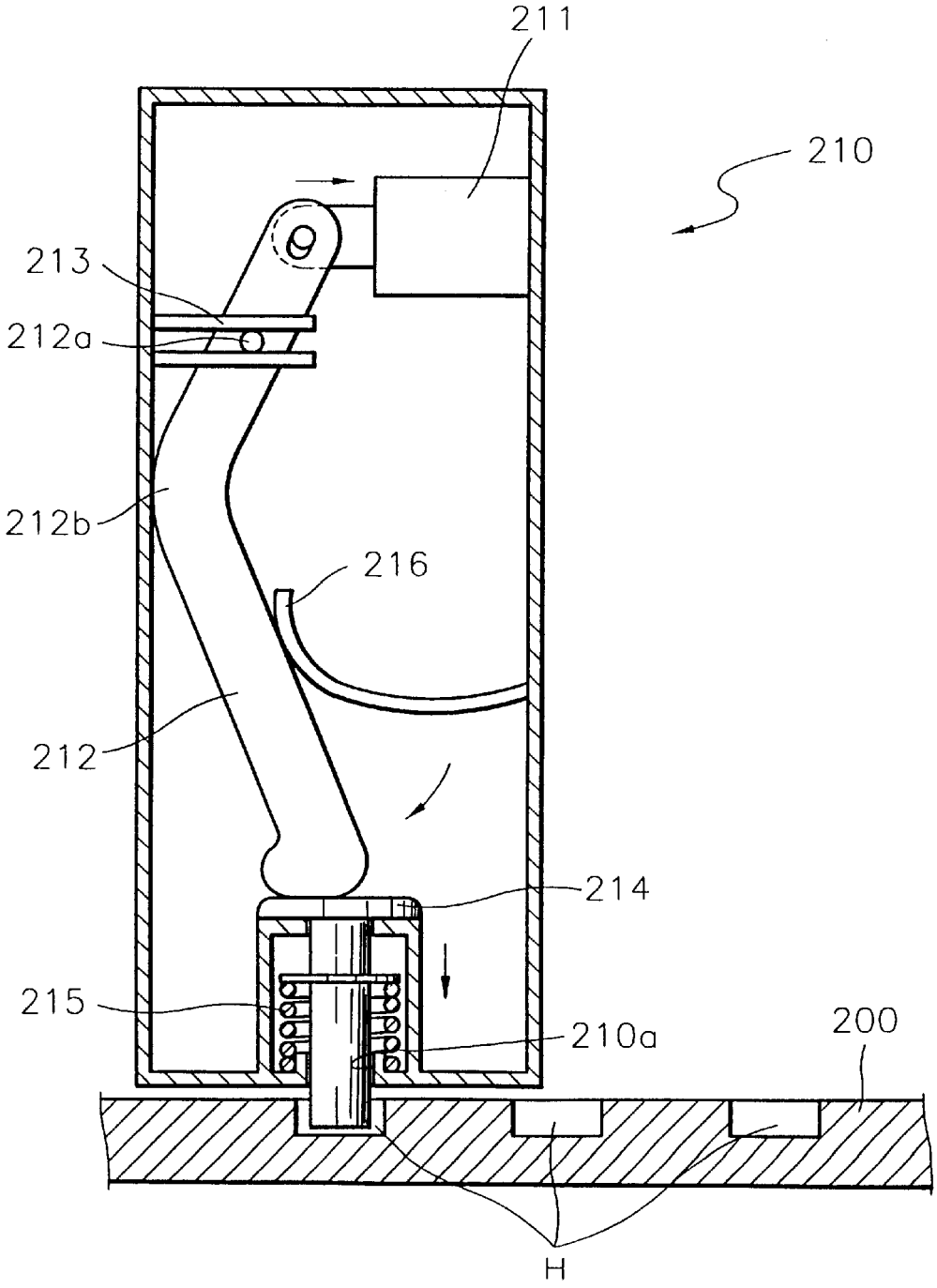

When the position of the guide 210 is predetermined, the solenoid 211 is moved backward so that the pivot lever 212 rotates clockwise around the hinge portion 212*b*, as shown in FIG. 7. Thus, the lower end of the pivot lever 212 contacts the upper surface of the stopper 214 to press down on the stopper 214, so that the end of the stopper 214 is inserted into a predetermined position determining hole H.

Here, the stopper 214 is pressed by the pivot lever 212, so that the guide 210 is stably maintained without leaving the position determining hole H. Thus, the stopper 214 cannot leave the position determining hole H due to shocks when the paper supply tray according to the present invention is inserted into or detached from the main body 200.

Meanwhile, according to the present invention, the pair of side guides 210 and 220 include locking mechanisms, respectively, and the side guides 210 and 220 are interlocked with each other by a rack and pinion 260 (FIG. 4) so that the effect of the present invention can be realized by the locking mechanism installed in one of the side guides 210 and 220.

It is contemplated that numerous modifications may be made to the paper supply tray for a printer of the present invention without departing from the spirit and scope of the invention as defined in the following claims.

What is claimed is:

1. A paper supply tray of a printer, the paper supply tray comprising:

a main body, for receiving sheets of paper or other printable material, insertable into and detachable from the printer;

a first guide for supporting a first edge of the received sheet, and capable of sliding in the main body;

a locking mechanism for immovably locking the first guide; and a plurality of position determining holes formed in the main body along a first path where the first guide is slidable;

the locking mechanism further comprising:

an actuator;

a pivot lever installed in the first guide, the pivot lever having a hinge portion which is bent and contacts an inner wall of the first guide, and having an upper end interlocked with the actuator;

a stopper installed in the first guide to move up and down, the stopper selectively interlocking with a lower end of the pivot lever and moving down when the pivot lever is rotated, the stopper thereby being partially inserted into one of the position determining holes;

a first elastic member supplying elasticity and interacting with the stopper to move the stopper up and, thereby, out of the position determining hole; and a second elastic member supplying elasticity to the pivot lever to contact the hinge of the pivot lever with the inner wall of the first guide.

2. The paper supply tray of claim 1, further comprising protrusions, protruded from the pivot lever, and support rails, supporting the protrusion formed in the guide, wherein the protrusions are slidable along the support rails when the pivot lever is rotated.

3. The paper supply tray of claim 1, further comprising:

a second guide for supporting a second edge of the received sheet, and capable of sliding in the main body along a second path where the second guide is slidable; and a rack and pinion mechanism disposed in the paper supply tray to interlock the first guide with the second guide.

* * * * *